US005217163A

United States Patent [19]

Henshaw

[11] Patent Number: 5,217,163

[45] Date of Patent: * Jun. 8, 1993

[54] ROTATING CAVITATING JET NOZZLE

[75] Inventor: Terry L. Henshaw, Battle Creek, Mich.

[73] Assignee: NLB Corp., Wixom, Mich.

[ * ] Notice: The portion of the term of this patent subsequent to Feb. 11, 2009 has been disclaimed.

[21] Appl. No.: 629,215

[22] Filed: Dec. 18, 1990

[51] Int. Cl.[5] ..... E21B 7/18

[52] U.S. Cl. ..... 239/101; 239/251; 239/590; 175/67; 175/424

[58] Field of Search ..... 239/590, 499, 518, 11, 239/590.3, 590.5, 381, 251, 258, 263, 101; 175/424, 67; 134/22.12, 198

[56] References Cited

U.S. PATENT DOCUMENTS

| | | | |
|---|---|---|---|
| 1,165,240 | 12/1915 | Gault et al. | 239/518 |
| 3,528,704 | 9/1970 | Johnson, Jr. | 239/499 |
| 3,713,699 | 1/1973 | Johnson, Jr. . | |
| 3,807,632 | 4/1974 | Johnson, Jr. . | |
| 4,262,757 | 4/1981 | Johnson, Jr et al. | 175/424 |
| 4,342,425 | 8/1982 | Vickers | 239/424 |
| 4,389,071 | 6/1983 | Johnson, Jr. et al. . | |
| 4,391,339 | 7/1983 | Johnson, Jr. et al. | 175/424 |
| 4,821,961 | 4/1989 | Shook | 239/253 |
| 5,024,382 | 6/1991 | Shook et al. | 239/251 |
| 5,086,974 | 2/1992 | Henshaw | 239/590 |

FOREIGN PATENT DOCUMENTS

| | | | |
|---|---|---|---|
| 655286 | 2/1935 | Fed. Rep. of Germany | 239/590 |
| 3432507 | 3/1986 | Fed. Rep. of Germany | 134/198 |
| 403191 | 6/1966 | Switzerland | 239/251 |

OTHER PUBLICATIONS

Cleaning and Cutting with Self-Resonating Pulsed Water Jets, Hydronautics, Incorporated, Laurel, Md. 20707.

The Centerbody Cavijet, Tracor Hydronautics, Laurel, Md. 20707.

Industrial Applications for Rotating Nozzle Technology, M. T. Gracey NLB Corporation, Wixom, Mi. 48096.

Rapid Cutting of Pavement with Cavitating Water Jets, Andrew F. Conn Tracor Hydronautics, Inc. Laurel, Md. U.S.A.

Some Unusual Applications for Cavitating Water Jets, Andrew F. Conn Tracor Hydronautics, Inc., Laurel, Md., U.S.A.

An Automated Explosive Removal System Using Cavitating Water Jets, Andrew F. Conn, Tracor Hydronautics, Inc. Laurel, Md., U.S.A.

A Material Failure Model for Pulsed Jet Impact, Thomas J. Labus, University of Wisconsin-Parkside Engineering Science.

Research Facilities Using Cavitating Water Jet Techniques to Test Materials, Michael T. Gracey and Andrew F. Conn, Tracor Hydronautics.

Cavitation Erosion Used for Material Testing, Gracey and Conn, Jet Technology Systems Division of Tracor Hydronautics, Inc.

Sandroid Systems, Inc., Division of Mobile Robot Corporation Gary K. Sweet, Vice President.

The Application of High Pressure Water Jet Technology, David Summers University of Missouri-Rolla, May 23, 1983.

*Primary Examiner*—Andres Kashnikow
*Assistant Examiner*—Christopher G. Trainor
*Attorney, Agent, or Firm*—Dykema Gossett

[57] ABSTRACT

A rotating head mounts a nozzle which creates cavitation in a pressurized fluid such that a surface may be quickly and efficiently cleaned. The rotation of the nozzle ensures a relatively wide cleaning path. The cavitation allows cleaning using only the pressurized fluid jet without any necessary abrasives, while still fully utilizing high rotational speeds. A preferred cavitating jet nozzle is also disclosed for producing cavitation in the pressurized fluid. The cavitating jet nozzle includes a pin received at a central position which lowers the pressure of the pressurized fluid such that cavitation bubbles form in the fluid. The pin is self-centering within the nozzle since it is free floating relative to a securing member which retains the pin in the nozzle. In addition, the pin preferably has an end face upstream of an outlet portion of the nozzle.

3 Claims, 2 Drawing Sheets

ROTATING CAVITATING JET NOZZLE

BACKGROUND OF THE INVENTION

This application relates to an improved nozzle for applying a fluid to a surface to be cleaned. More particularly, this invention relates to such a nozzle in which a member is positioned within the nozzle to create cavitation and apply a cavitating jet to thoroughly clean the surface, and wherein the nozzle is rotated to clean a large surface area efficiently.

Modern cleaning systems often use a fluid jet to remove rust, scale or coatings from a surface to be cleaned. Typically, these surfaces are cleaned by the application of a fluid which carries an abrasive substance, such as sand. The use of a fluid carrying an abrasive is well known and commonly utilized to clean surfaces such as metal down to a bare metal surface. In many prior art systems, the use of a fluid without a abrasive material would not effectively clean the surface.

It is sometimes undesirable to use an abrasive carried in a fluid, since the abrasive may escape from the fluid and be mixed into the air surrounding the cleaning area. Further, the abrasive material may get into nearby machinery. Further, the abrasive material may contaminate environmental air and/or water. All these results are undesirable. For this reason, it is desirable to develop a cleaning system that utilizes a fluid jet which does not carry an abrasive material.

It is known in the prior art to utilize cavitation to increase the cleaning power of a fluid jet. Essentially, the principle of cavitation involves lowering the pressure of a fluid below its vapor pressure. As the fluid reaches pressures below the vapor pressure, bubbles of vaporized fluid form in the jet. As the jet strikes a surface to be cleaned, these bubbles implode and remove rust, scale or other impurities. Cavitation may be undesirable in pumping fluids and for other fluid applications, however, it is beneficial in cleaning applications.

Problems exist with prior art nozzles which utilize cavitation since it is difficult to cause an adequate cavitation effect in a mass produced nozzle. It should be appreciated that in order for the nozzle to actually produce substantial cavitation bubbles, internal members must be accurately formed and positioned.

In some prior art devices, a pin member is received in the nozzle to lower the pressure of the fluid, thereby creating cavitation. It has been found that this pin member should be accurately positioned within the nozzle and centered along a nozzle center axis. It is very difficult to center and to maintain the pin centered within the nozzle. These fixed pins often moved off-center with use, which decreased the efficiency of the cavitating nozzles. Further, it is difficult to accurately set the axial position of the pin, which is an important variable in the efficiency of a cavitation nozzle. In addition, since these prior art pins were typically fixed relative to the nozzles, close attention was required during assembly to ensure that the pins were centered within the nozzles. This has resulted in the prior art cavitating nozzles being less efficient than desired.

In addition, it has been known to supply a pressurized fluid from nozzles mounted in a rotating head. The use of such nozzles allows relatively wide coverage on a surface to be cleaned, since the nozzles are rotated through an arc rather than directed along a single line. The prior art rotating heads are often rotated by forces from the pressurized fluid. The use of such nozzles has provided a number of benefits, however, there are some deficiencies in the use of these rotating fluid heads.

As explained above, the use of a pressurized fluid by itself has not adequately cleaned certain surfaces. Further, the use of the fluid by itself takes a relatively long period of time to clean the surface. The high rotational speeds which are available from a high pressure fluid could allow very rapid cleaning of large surfaces. It would be preferable to utilize the cavitation principle discussed above in combination with a rotating fluid head, such that the jet exiting a nozzle will quickly and efficiently clean the surface.

It is therefore an object of the present invention to disclose a cavitating jet nozzle mounted in a rotating fluid head for the purposes of cleaning a relatively large area in a relatively short time.

SUMMARY OF THE INVENTION

In a disclosed embodiment of the present invention, a cavitating nozzle includes a throat with a first conically decreasing bore leading into a second bore, which leads to an outlet. A pin is centered within the first bore, and a pressurized fluid supply is communicated to the outer periphery of the pin. The pin, in combination with the first bore, lowers the pressure of the pressurized fluid such that it is below the vapor pressure for its temperature, which produces cavitation. Bubbles form in the fluid jet and flow outwardly of the nozzle to strike a surface to be cleaned. In a disclosed embodiment, the pin is free-floating such that it is self-centering within the bore.

In a preferred embodiment, a pin securing member is received axially adjacent to one end of the first bore, and includes a central pin aperture of a first diameter greater than the outer diameter of a pin received in the pin aperture. Since the pin diameter is less than the diameter of the pin aperture, the pin is free-floating within the aperture. Due to a basic fluid phenomena known as the Lomakin effect, the pin remains at the center of the first bore. Essentially, the Lomakin effect occurs with a center member surrounded by a fluid moving axially past the center member. The member will tend to remain centered, since if it moves off center the pressure on the side it is moving towards will increase relative to the pressure on the side it is moving away from, and the member will be urged back towards the center. Due to this effect, the inventive free-floating pin is self-centering within the first bore.

Preferably, the pin securing member abuts an end of the throat such that the pin is accurately positioned axially within the throat. Because of the small angle on the sides of the conical first bore, the flow area at the tip of the pin varies slowly with axial location. This broadens the range of effective axial locations of the tip of the pin, resulting in less-critical axial location of the tip. The pin securing member is preferably secured by an adhesive within a nozzle housing, which also receives the throat.

In a most preferred embodiment of the present invention, the pin securing member includes a plurality of fluid ports spaced circumferentially about, and radially outwardly, of the pin aperture. A pressurized fluid is led into these ports and passes through the first bore outside of the pin to the second bore and the outlet.

In a most preferred embodiment of the present invention, the pin ends at a point within the conically converging first bore and defines an end face. The first bore could be said to have an inlet at an upstream end and an outlet at the downstream end. The end face of the pin is located somewhere between the inlet and outlet. In a most preferred embodiment, the end face is of a cross-sectional area approximately equal to the cross-sectional area of the first bore at the outlet end. In addition, in a most preferred embodiment, the cross-sectional flow area between the pin and the first bore at the end face is approximately equal to the cross-sectional area of the end face at the outlet port. The cavitation produced in the fluid jet at this pin position is quite good.

The disclosed cavitating jet nozzle will be self-centering since the Lomakin effect will ensure that the pin will remain approximately at the centerline of the first bore. This is a great improvement over the prior art systems in which the delicate pin members had to be manually centered.

Further, in a disclosed embodiment of the present invention, the inventive cavitating jet nozzle or nozzles is mounted in a rotating fluid head used as a cleaning member. By rotating the cavitating nozzle, a relatively wide path is cleaned in a relatively short time. Due to the use of the cavitating jet nozzles, the jets of fluid quickly and efficiently clean the surface and remove any rust, scale or other coatings. In some prior art devices, the rotating fluid heads may have rotated so quickly that the jets of fluid did not effectively clean the surface. With the inventive cavitating jet nozzles, however, the cavitating principle efficiently cleans the surface such that the full speed provided by rotating fluid jet technology is effectively utilized.

In one embodiment of the present invention, the rotating head is mounted to a hand-held cleaning lance which is directed along the surface to be cleaned. In a second embodiment of the present invention, a rotating head is mounted to an arm of a robotic manipulator which is then directed along a surface to be cleaned. Further embodiments are envisioned, and the invention extends to any rotation of a cavitating jet nozzle.

The use of the rotating head ensures a relatively wide cleaning path along the surface to be cleaned. The cavitation ensures rapid removal of scale, rust or other coatings and allows the full exploitation of the rapid rotational speeds provided by high pressure fluids.

In a disclosed method according to the present invention, a path is cleaned along a first longitudinal direction from one end of the surface to be cleaned to the other. Subsequently, a path is then cleaned in the opposite direction parallel to the first path. By moving the rotating jet fluid nozzles along the surface to be cleaned in subsequent opposite directions, the surface may be quickly and efficiently cleaned.

These and other objects and features of the present invention can be best understood from the following specification and drawings of which the follow is a brief description.

DETAILED DESCRIPTION OF A PREFERRED EMBODIMENT

Figure 1:
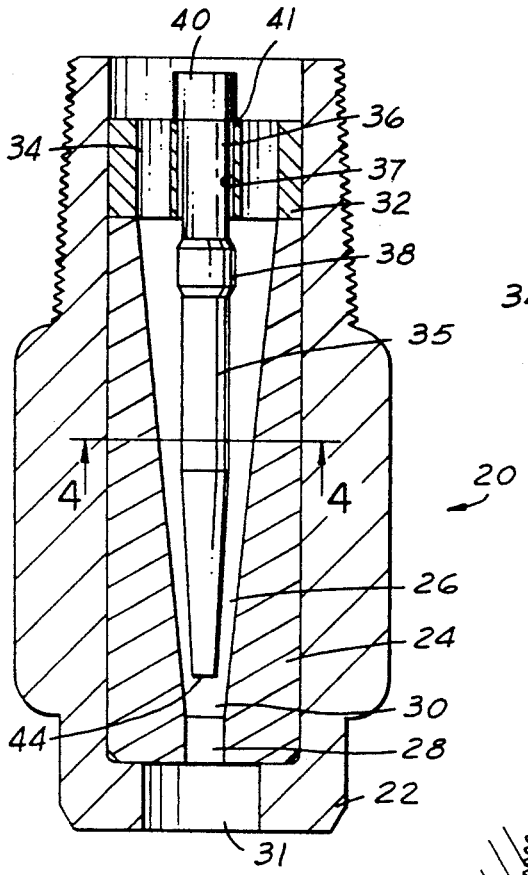
FIG. 1 is a cross-sectional view through a cavitating jet nozzle according to the present invention.

Cavitating jet nozzle 20 can be understood from FIGS. 1–5. As shown in FIG. 1, nozzle 20 includes nozzle housing 22 which receives throat 24. Throat 24 defines a first conically decreasing bore 26 which leads into second bore 28. First bore 26 has inlet 29 of a first diameter and outlet 30 of a second diameter smaller than the first diameter. The diameter of second bore 28 is preferably identical to the diameter of outlet 30 throughout its length. Housing outlet 31 leads from nozzle housing 22 such that a fluid can be applied to a surface to be cleaned.

Pin securing member 32 is connected with an adhesive to nozzle housing 22 and abuts an end of throat 24 such that pin securing member 32 is easily and accurately positioned. Preferably, Loctite TM type adhesive is utilized. Pin securing member 32 includes a plurality of ports 34 spaced outwardly of pin 35. Pin 35 includes portion 36 received within central pin aperture 37 in pin securing member 32. The inner diameter of central pin aperture 37 is greater than the outer diameter of pin portion 36. Thus, pin 35 can float radially within central pin aperture 37. This allows pin 35 to be self-centering with respect to pin securing member 32, and also with respect to first bore 26, as will be described below.

Lower pin stop 38 is formed on one end of pin portion 36 and upper pin stop 40 is formed on the other end. The outer diameters of upper and lower pin stops 38 and 40 are preferably greater than the inner diameter of central pin aperture 37 such that pin 35 cannot pass through central pin aperture 37, but is retained within pin securing member 32.

As a preferred alternative to lower pin stop 40, a roll pin could be positioned above upper pin stop 40 to prevent removal of pin 35. As an example, housing 22 could extend further upwardly than shown in FIG. 1 and receive a roll pin at a location above upper pin stop 40. That roll pin will prevent removal of pin 35.

Pin 35 extends downwardly into first bore 26 to an end face 44. End face 44 is at a location between inlet 29 and outlet 30. In a most preferred embodiment of the present invention, end face 44 is at a position between inlet 29 and outlet 30 such that the cross-sectional area of end face 44 is equal to the flow area between first bore 26 and end face 44 at the location of end face 44. This location can be easily determined provided the decreasing angle of first bore 36 is known. In a disclosed embodiment, this angle is 17 degrees. Further, end face 44 is preferably of the same cross-sectional area as outlet 30. The above cross-sectional areas are all measured in a plane perpendicular to the center axis of first bore 26.

A chamfered groove 41 is formed in pin securing member 32 to receive pin 35 at upper pin stop 40. Chamfered groove 41 guides pin 35 as it floats to center itself.

Figure 2:
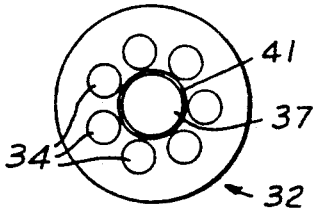
FIG. 2 is a end view of a pin securing member according to the present invention.

Pin securing member 32 is illustrated in FIG. 2 including a plurality of ports 34 spaced circumferentially about, and radially outwardly of pin aperture 37. Ports 34 pass fluid such as water from an upstream fluid supply into first bore 26. As fluid passes over pin 35, its pressure drops and cavitation bubbles form. The fluid jet leaves housing outlet 31 and impinges upon a surface to be cleaned. The bubbles implode and clean the surface.

Figure 3:
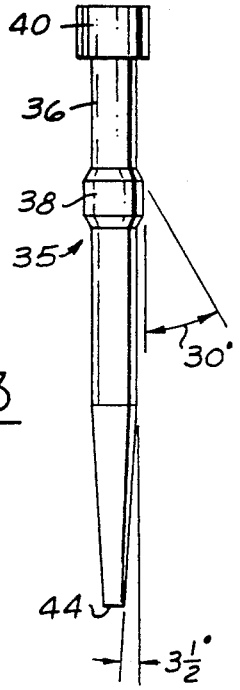
FIG. 3 is a side view showing a pin according to the present invention.

FIG. 3 is a side view of pin 35 according to the present invention. Pin securing portion 36 is located between lower pin stop 38 and upper pin stop 40. End face 44 is the lowermost extent of pin 35. As shown, lower pin stop 38 flares outwardly to wedge into central aperture 37 at an angle, in the disclosed embodiment 30 degrees. Also, the lower extent of pin 35 converges conically inwardly at a slight angle to end face 44, in the disclosed embodiment 3½ degrees.

Figure 4:
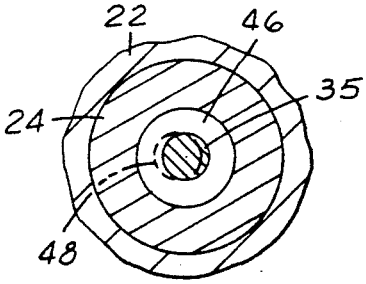
FIG. 4 is a fragmentary cross-sectional view along lines 4—4 as shown in FIG. 1.

FIG. 4 illustrates the Lomakin effect which ensures that pin 35 will be approximately self-centered within first bore 26. Pin 35 is received within flow area 46 defined by first bore 26. Should pin 35 move off to the left of a center line position to displaced position 48, the pressure to the left of pin 35 will become greater than the pressure to the right of pin 35. A force is then applied to pin 35 urging it back to the right to the center line position. Since pin 35 in the inventive nozzle 20 is free-floating within pin securing member 32, pin 35 moves easily back to the center position and remains centered on a center axis of first bore 26.

Figure 5:
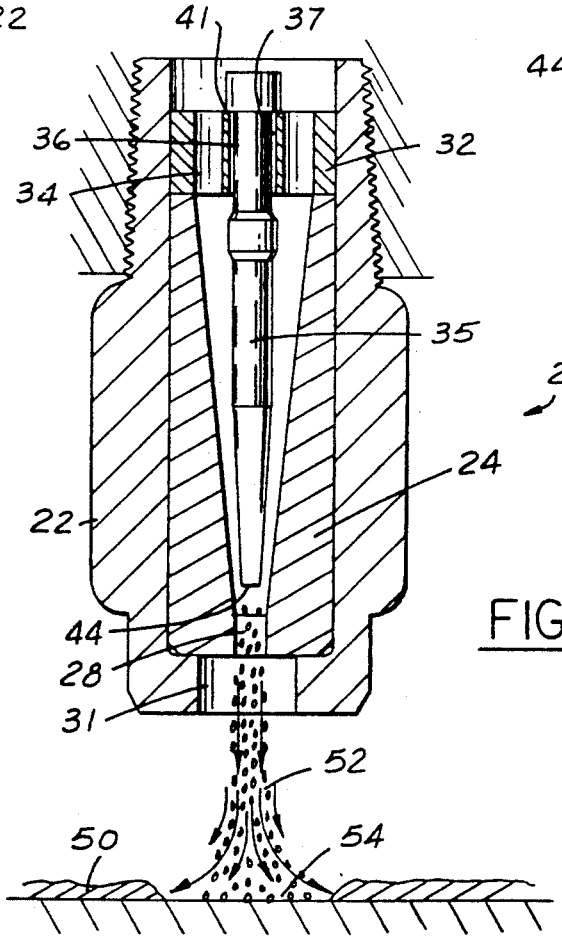
FIG. 5 is a cross-sectional view similar to FIG. 1 and showing the fluid jet leaving the nozzle to clean a surface.

FIG. 5 illustrates cavitating nozzle 20 being used to clean surface 50. Surface 50 has a coating of paint, rust or scale that is to be removed. Fluid jet 52 leaves housing outlet 31 and impinges on surface 50. The cavitation bubbles and the jet remove the paint, rust or scale such that a clean surface 54 remains.

In a most preferred embodiment, at least one of the pin or throat is formed of tungsten carbide, the other may be stainless steel.

With a nozzle according to the present invention, cavitation bubbles ensure a surface is thoroughly cleaned and all rust, scale or other coatings are removed, and when used to clean a metal surface the fluid jet cleans down to the bare metal. This is known as white metal cleaning. In addition, it is not necessary to include abrasives in the fluid jet. The pressurized fluid, which is preferably water, can clean the surface on its own.

Figure 6:
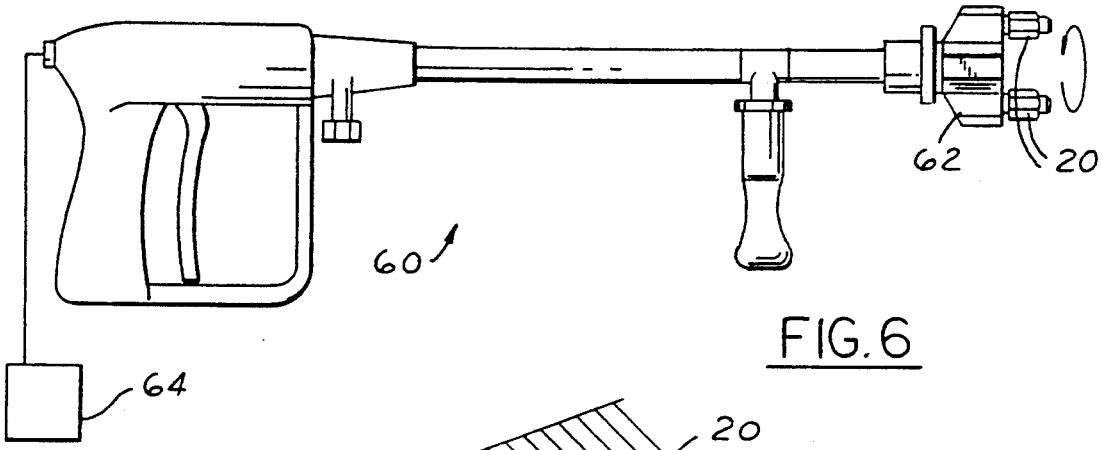
FIG. 6 is a side view showing the inventive nozzles being received on a hand-held cleaning lance with a rotating fluid head.

FIG. 6 illustrates a hand-held cleaning lance 60 which mounts a rotating head 62 including a pair of cavitating jet nozzles 20. It should be understood that although two nozzles are illustrated, rotating head 62 could mount any number of nozzles. Rotating head 62 is preferably rotated by the force of a pressurized fluid supplied from fluid supply 64 to nozzles 20. Nozzles 20 are angled relative to a central axis of head 62, such that reaction force causes the head to rotate. Rotating head 62 is most preferably mounted on a fluid bearing provided by the pressurized fluid sent to nozzles 20. In a most preferred embodiment, the hand-held cleaning lance and rotating head 62 are of the type disclosed in U.S. Pat. No. 4,821,961, which issued to Shook, et al. and is owned by the Assignee of the present application.

Figure 7:
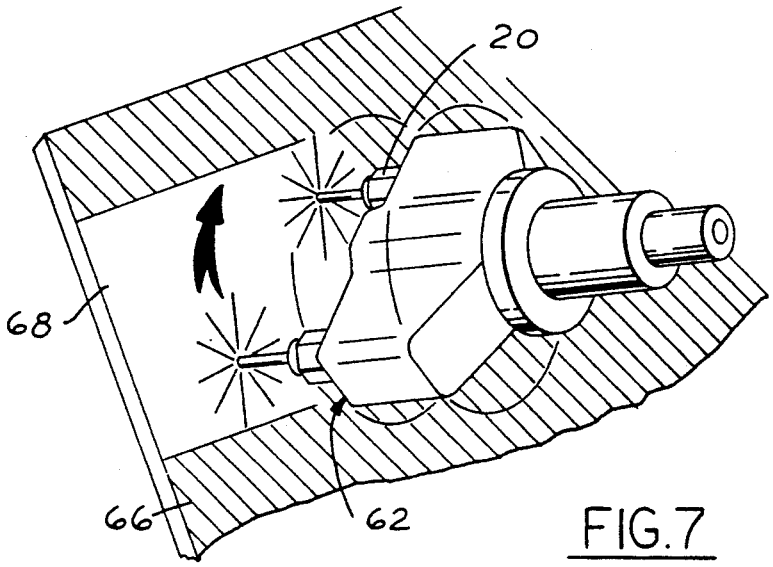
FIG. 7 is a view illustrating the cleaning effect of a rotating head utilizing the inventive nozzles.

As shown in FIG. 7, nozzles utilized with rotating head 62 clean a relatively wide path along a surface 66 which is to be cleaned. As shown, the path 68 is much wider than the width of either nozzle 20. As nozzles 20 rotate, they move along the arc they rotate through. As rotating head 62 is moved, the rotation cleans the wide path 68. In a most preferred method according to the present invention, rotating head 62 is moved along a longitudinal direction on surface 66 and cleans path 68. Once the path reaches an end of surface 66, cleaning lance 60 is returned in the opposite direction along a parallel adjacent path. The use of the cavitation nozzles 20 increases the cleaning speed of the fluid jet thus allowing a relatively large surface area to be quickly and efficiently cleaned. This method can be utilized with any cleaning tool incorporating a rotating head, and with any type of nozzle which creates cavitation.

Figure 8:
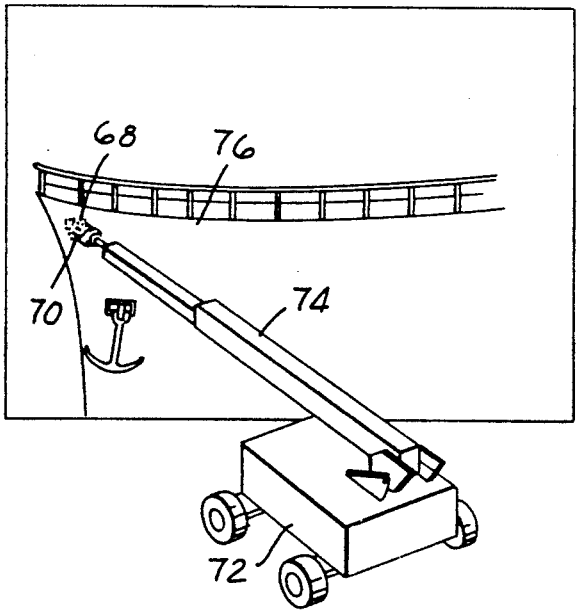
FIG. 8 is a partially schematic view showing a rotating head including the inventive nozzles being attached to a robotic manipulator to clean large surfaces.

FIG. 8 shows an enlarged surface 68 being cleaned by rotating head 70 which includes a number of cavitating jet nozzles 20 according to the present invention. Preferably, rotating head 70 is controlled by robotic manipulator 72 through arm 74. The details of the manipulator are known in the prior art and form no part of this invention. As shown, rotating head 70 is moved along surface 68 and cleans path 76. Again, due to the use of the cavitating jet nozzles 20, the fluid pressure quickly and efficiently cleans surface 68 allowing robotic manipulator 70 to move relatively rapidly when compared to prior art systems.

Although a specific cavitating nozzle is disclosed, it should be understood that this invention extends to any type of cavitating nozzle used in a rotating head cleaning tool.

A preferred embodiment of the present invention has been disclosed, however, a worker of ordinary skill in the art would realize that certain modifications would come within the scope of this invention, thus, the following claims should be studied on order to determine the true scope and content of the present invention.

I claim:

1. A method of cleaning a surface comprising the steps of:

supplying a pressurized fluid to an inlet of a nozzle and dispensing the fluid from an outlet of the nozzle, a bore extending between the inlet and the outlet;

disposing a pin in the nozzle which creates cavitation in the pressurized fluid, the pin extending axially between two end portions and received in the bore, the first end portion retained within the bore adjacent the inlet to the nozzle, a second end portion extending from the first end portion towards the outlet of the nozzle, the pin being free-floating relative to the nozzle throughout its axial length such that the pin may be self-centering on a central axis of the bore throughout its axial length;

directing the outlet of the nozzle onto a surface to be cleaned;

rotating the nozzle about a rotational axis; and moving the nozzle along the surface to be cleaned.

2. The method of claim 1, wherein two nozzles are mounted in a single head which is rotated.

3. The method as recited in claim 1, wherein the movement of the nozzle is along parallel lines in subsequent, opposite directions.

* * * * *